United States Patent [19]

DeMars

[11] Patent Number: 4,654,274

[45] Date of Patent: Mar. 31, 1987

[54] REUSABLE CUP HOLDER

[76] Inventor: Robert A. DeMars, 7932 Maestro, Canoga Park, Calif. 91304

[21] Appl. No.: 739,564

[22] Filed: May 30, 1985

Related U.S. Application Data

[63] Continuation-in-part of Ser. No. 574,736, Jan. 30, 1984.

[51] Int. Cl.[4] ..... B65D 25/28

[52] U.S. Cl. ..... 428/542.4; 215/100 A; 220/94 R; 220/96; 248/310; 248/311.2; 248/DIG. 8; 428/16

[58] Field of Search ..... 428/16, 542.4; D7/70; 248/DIG. 8, 231, 316.8, 310, 311.2; 224/148; 222/173; 220/94 R, 96; 215/100 A

[56] References Cited

U.S. PATENT DOCUMENTS

| | | | |
|---|---|---|---|
| D. 187,501 | 3/1960 | Hagenes | 428/16 X |
| D. 209,533 | 12/1967 | Cole | D7/70 |
| D. 265,880 | 8/1982 | Craig | D7/70 |
| 2,070,414 | 2/1937 | Snell | 428/131 X |
| 2,801,743 | 8/1957 | Geen | 220/94 R X |
| 2,838,202 | 6/1958 | Huether | 220/94 R X |
| 2,933,280 | 4/1960 | Hard | 428/16 X |
| 3,029,975 | 4/1962 | Aiello | D7/70 X |
| 3,458,164 | 7/1969 | Massey | D7/70 X |
| 3,592,501 | 7/1971 | Stokes et al. | D7/70 X |
| 3,825,151 | 7/1974 | Arnaud | 220/94 R |
| 4,273,816 | 6/1981 | Tollette | 428/187 X |

*Primary Examiner*—Henry F. Epstein
*Attorney, Agent, or Firm*—Cislo & Thomas

[57] ABSTRACT

This invention is directed towards a cup holder for cooperative association with a cup comprising (a) an upper expansible collar portion to receive and retain therein, in a releasable friction fit, a portion of the sidewall of the cup adjacent the upper collar portion; (b) a spaced, cooperating lower extending support portion having an upper surface adapted to frictionally and releasably engage and retain the bottom of the cup thereon; and (c) an intermediate depending, extending, shank portion outwardly spaced from the upper collar portion and the lower extending support portion forming a hand-graspable surface or handle, spaced from the exterior of the cup. In an alternate embodiment, the handle is releasably secured to the upper collar portion and the lower extending support portion.

18 Claims, 7 Drawing Figures

REUSABLE CUP HOLDER

CROSS-REFERENCE TO RELATED APPLICATION

The present application is a continuation-in-part application of Ser. No. 06/574,736, filed Jan. 30, 1984.

BACKGROUND OF THE INVENTION

This invention pertains to handles, especially adapted for association with cups, such as those disposable paper cups in fast food, sports stadium special outside attractions and the like restaurants, having frusto-conical sidewalls and the exterior surface of its bottom with a concave portion. The cup holder of the invention is easily associated with such previously described cups, thereby making their manipulation with the human hand relatively easy, especially for small children or those with dexterity problems, as opposed to not having the handle.

Almost everyone has encountered the difficulties inherent in the disposable paper cups commonly used to hold coffee, soda, malts and the like, sold by fast food and the like restaurants. Due to the frusto-conical sidewall, the mouth of the cup is larger than the bottom or base of the cup, thereby presenting a situation where the cup may be easily tipped, spilling its contents. It is particularly difficult for young children having still developing muscle-brain coordination, to be able to grasp disposable paper cups without spilling the contents. In many instances, children must use two hands in holding the cup, which increases the chances of a spill. Even an adult may apply excessive pressure to the sidewall of the cup, thereby rupturing the cup, or accidentally brush against the cup with his hand, knocking the cup over and spilling its contents. In many instances, when a disposable paper cup is filled with hot liquid, such as tea, coffee or soup, the sidewall becomes too hot to touch or hold in the hand.

While the prior art has suggested various cup holders and the like, none has suggested a cup holder having an upper expansible, collar-like portion to receive and retain therein, in a releasable friction fit, a portion of the sidewall of the cup adjacent the upper expansible collar-like portion. Also, none has suggested a spaced cooperating lower support portion having an upper surface adapted to frictionally and releasably engage and retain the bottom of the cup thereon.

Further, the provision of a cup holder for cooperative association with a cup comprising an upper expansible collar-portion to receive and retain therein, in a releasable friction fit, a portion of the sidewall of the cup adjacent the upper collar portion, and a spaced cooperating lower extending support portion having an upper surface adapted to frictionally and releasably engage and retain the bottom of the cup thereon and an intermediate depending, extending shank portion outwardly spaced from the upper collar portion and the lower extending support portion has never been suggested as far as is known.

Also, there appears to be no suggestion in the art disclosing an intermediate depending, extending shank portion, or handle, outwardly spaced from the upper collar portion and the lower support portion that is releasable therefrom.

Moreover, the degree of ease of association of the cup holder of the invention with a cup, its relatively unbreakable construction, as well as its relatively low cost to manufacture, makes it practical to almost eliminate clumsy handling of cups causing spills by increasing the stability of the cup when placed on a table or the like, or when held by a hand grasping the handle portion of the invention.

OBJECTS AND SUMMARY OF THE INVENTION

It is an object of the invention to provide a cup holder to receive and retain therein cups.

It is another object of the invention to provide a handle for cooperative association with cups to provide ease of grasping same and improved stability of the cup so associated on surfaces such as tables and the like.

It is another even more important object of the invention to provide a cup holder for disposable plastic or paper cups having a frusto-conical sidewall.

It is another even further, more specific important object of the invention to provide a cup holder for cooperative association with cups wherein the cup holder is essentially of resilient, molded plastic material or the like and which is easily associated with the cup and wherein the cup holder is expansible to accommodate various sized cups.

It is another even further, even more specific and important object of the invention to provide a cup holder of the type which has an upper expansible collar-like portion to receive and retain therein, in a releasable friction fit, a portion of the sidewall of the cup adjacent the upper expansive collar-like portion.

It is another even further, even more specific and important object of the invention to provide a cup holder of the type having a spaced, cooperating lower extending support portion having an upper surface adapted to frictionally and releasably engage and retain the bottom of a cup thereon.

It is still another object of the invention to provide a cup holder that includes a releasable handle.

In an exemplary embodiment, the invention is directed to a cup holder for cooperative association with a cup, comprising a handle having an upper expansible, reversible C-shaped collar portion of resilient plastic material having an inwardly canted frusto-conical sidewall, adapted to receive and retain therein in a releasable friction fit, a portion of the sidewall of the cup adjacent the upper expansible, C-shaped collar portion; and a spaced cooperating lower extending support portion, having on its upper surface a recessed, convex portion with frusto-conical sidewalls adapted to receive and retain therein the bottom and a portion of the sidewalls of the cup adjacent the bottom of the cup; and an intermediate depending, extending shank portion, outwardly spaced from the upper expansible C-shaped collar portion and the lower extending support portion, generally arcuate in overall configuration, so as to form a hand graspable surface, spaced from the exterior of the cup.

In another exemplary embodiment, the cup holder described above includes a releasable handle or shank portion. In this embodiment, the lower support portion is provided with an outward extension, having means for releasably engaging the bottom portion of the handle. The C-shaped upper collar portion is provided with means for releasably engaging the upper portion of the shank portion, or handle.

These and other objects of the invention will become more apparent from the hereinafter following commentary taken in conjunction with the following Figures of drawings.

DESCRIPTION OF THE BEST EMBODIMENTS CONTEMPLATED

Figure 1:
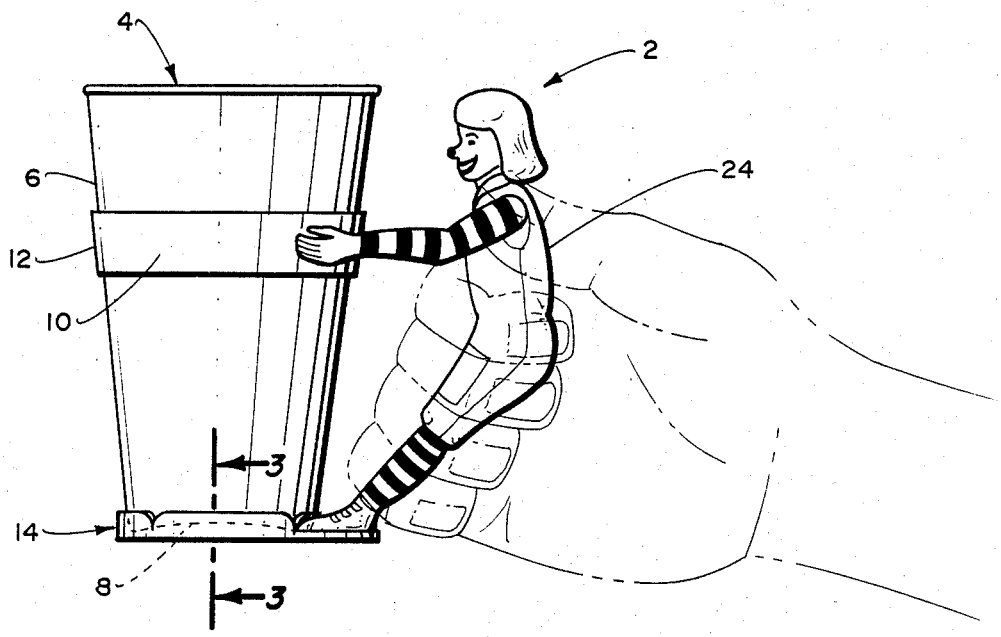
FIG. 1 is a side view of the invention with a cup therein showing a hand in phantom line grasping the handle of the invention, the figurine-shaped handle being shown for illustrative purposes only and not meant to limit possible handle shapes.

Referring to the Figures of drawings wherein like numbers of reference designate like elements throughout, it will be noted that in a preferred embodiment, the cup holder 2 of the invention cooperatively associates with a cup 4 having inwardly directed sidewall 6 and a bottom 8.

An upper expansible, C-shaped collar portion 10 of suitable resilient material, having an inwardly canted frusto-conical sidewall 12, is adapted to expand to receive and retain therein, in a releasable friction fit, a portion of sidewall 6 of cup 4 adjacent the sidewall 12 of the collar portion 10.

A suitable resilient material is plastic, as it is impervious to most liquids sold in such cups, such as soda, tea, coffee, or malts, and has a natural resiliency that would permit expansion of the C-shaped collar portion 10 to insert and retain, in a releasable friction fit, cup 4. Plastic is also a good insulator as it is slow to conduct heat.

A spaced, cooperating, lower extending support portion 14 is shown, generally parallel to upper collar 10. The upper surface 16 of support portion 14 has a convex portion 18 recessed into upper surface 16 with a frusto-conical sidewall 20 adapted to cooperatively engage and retain therein bottom 8 and a portion 22 of the sidewall 6 of cup 4 adjacent bottom 8 of cup 4.

Lower support portion 14 may also be fabricated from a resilient material, such as plastic, to permit a cup bottom to be received and retained therein in a releasable friction fit.

An intermediate depending, extending shank portion 24 is outwardly spaced from the upper collar portion 10 and the lower support portion 14.

Shank portion 24 is generally arcuate in overall configuration so as to form a hand-graspable surface, or handle, spaced away from sidewall 6 of cup 4.

Figure 2:
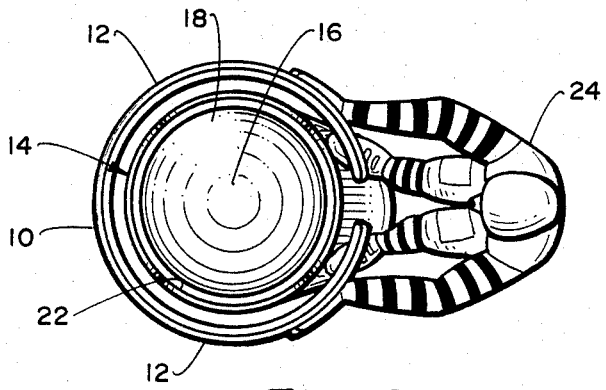
FIG. 2 is a top plan view of the invention with the cup removed to expose the upper surface of the bottom.
Figure 3:
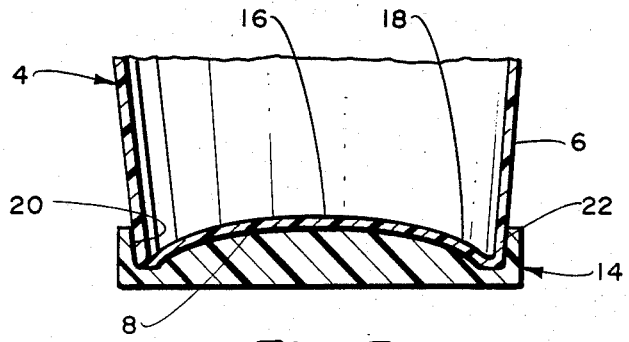
FIG. 3 is a cross-sectional view taken along the line 3—3 of FIG. 1.
Figure 4:
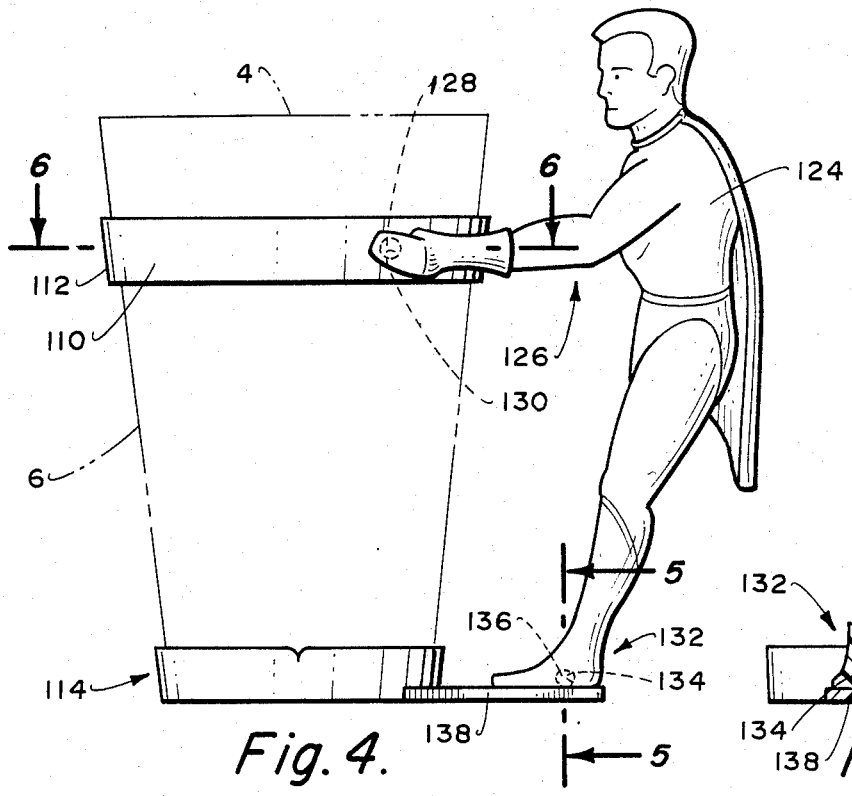
FIG. 4 is a side view of an alternate embodiment of the invention, with a cup therein shown in phantom, the figurine-shaped handle being shown for illustrative purpose only and not meant to limit possible handle shapes.
Figure 5:
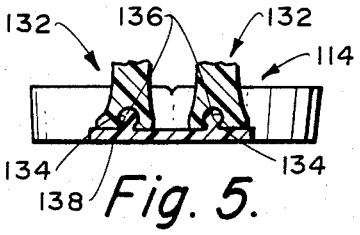
FIG. 5 is a cross-sectional view taken along the line 5—5 of FIG. 4.
Figure 6:
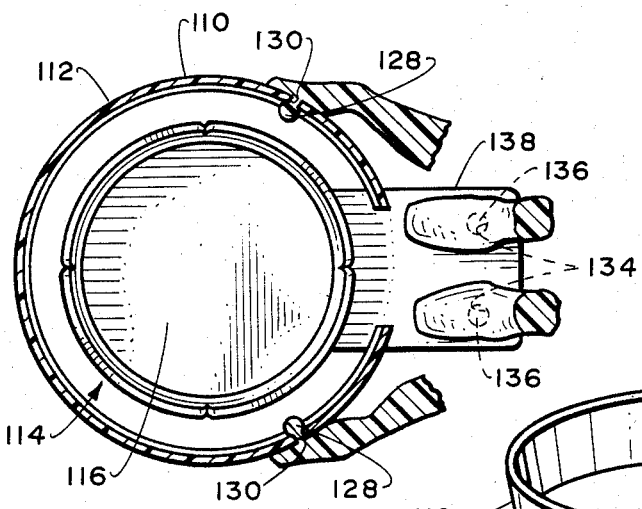
FIG. 6 is a cross-sectional view of the invention taken along the line 6—6 of FIG. 4.
Figure 7:
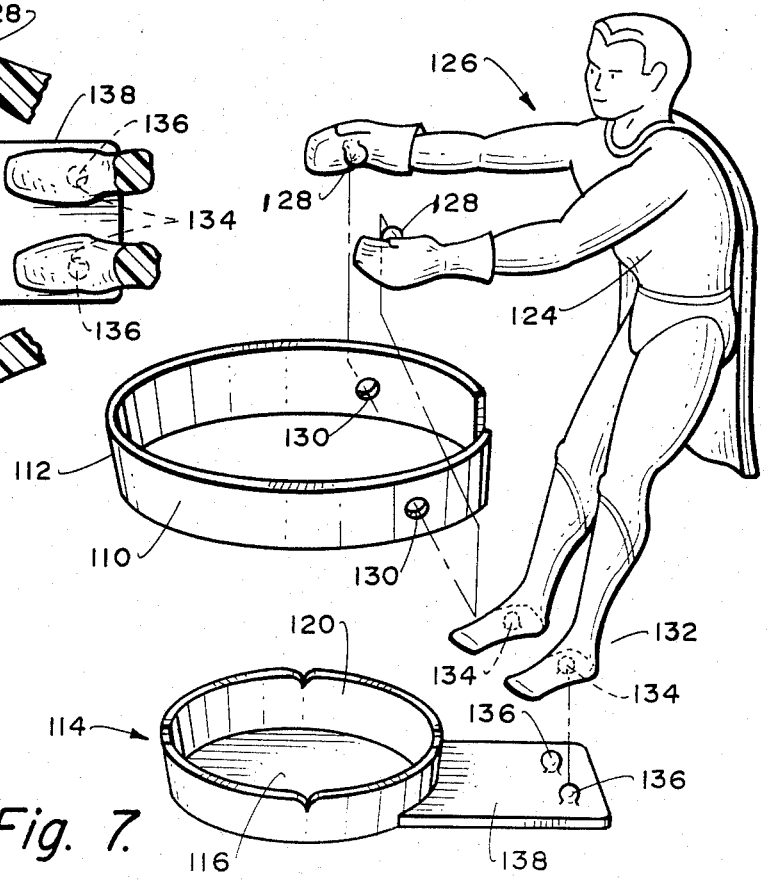
FIG. 7 is an exploded view in perspective, showing one means for releasably attaching the handle.

As illustrated in FIGS. 1 and 2, shank portion 24 may be formed into a recognizable figure, such as a cartoon character, or a famous person, in order to encourage children to utilize the invention.

In a preferred embodiment, the shank portion 24 is integrally formed with the upper collar portion 10 and the lower support portion 14 for ease of fabrication and economy of costs. Shank portion 24 may, however, be separately fabricated and operatively joined to upper collar portion 10 and lower support portion 14 by adhesive, heat bonding, and the like commercially known methods.

The cup holder of the invention described above in a preferred embodiment, may be used as described below.

In use, cup 4 is inserted into upper expansible, C-shaped collar portion 10 until cup bottom 8 is cooperatively engaged by recessed convex portion 18 of upper surface 16 of the lower support portion 14.

The resilient nature of the material used in the upper expansible, C-shaped collar portion 10 and the lower support portion 14 permits an expansion of the upper and lower portions to retain, in a releasable friction fit, the sidewall 6 and that portion of the cup sidewall adjacent the cup bottom 8 respectively therein.

Cup 4, cooperatively associated with cup holder 2 as described immediately above, may now be held by a hand grasping shank portion 24 which provides a handle as best shown in FIG. 1.

Once cup 4 is no longer desired, it may be disposed of as follows. Cup 4 may, by applying a force directed upward from the lower support portion 14, be released from the friction fit of upper portion 10 and lower portion 14 and removed therefrom for disposal. A new cup may now be inserted into the cup holder as described above.

Turning now to another embodiment of the invention, FIGS. 4 through 7 depict a releasably engaged shank portion 124 in cooperation with an upper expansible C-shaped collar portion 110 and a spaced, cooperating, lower extending support portion 114. The C-shaped collar portion includes an inwardly canted frusto-conical sidewall 112, identical in all respects to sidewall 12. The lower extending support portion 114 includes an upper surface 116 which may be convex, as described above for surface 16, or may be substantially flat. In any event, the lower support portion 114 includes a frusto-conical sidewall 120, which like sidewall 20, is adapted to cooperatively engage and retain therein the bottom portion of the cup 4.

In this embodiment, the shank portion 124, which again may be formed into a recognizable figure, is provided at its upper portion 126 with means 128, here, knobs or beads, which releasably engage in corresponding orifices 130 in the C-shaped collar 110 by snap or friction fitting relationship. The shank portion 124 is also provided at its bottom 132 with receptacles 134 for receiving corresponding knobs or beads 136 in releasable snap or friction fitting relationship. Knobs 136 are formed on a lip 138, which is an integral extension of the lower support portion 114. Other similar means for releasably engaging the C-shaped collar portion 110 and lower extending portion 114 in snap or friction fit may also be employed in the practice of the invention.

In all other respects, the C-shaped collar portion 110 is identical to the C-shaped collar 10, and the lower extending support portion 114 is identical to the lower extending support portion 14. Further, the operation of inserting a cup 4 and removing same is as described above. The materials employed in the construction of the various parts are those described above.

The invention described above is, of course, susceptible of many variations and modifications, all of which are within the skill of the art. It should be understood that all such variations and modifications are within the spirit and scope of the invention and of the appended claims. Similarly, it will be understood that it is intended to cover all changes, modifications and variations of the examples of the invention herein disclosed for the purpose of illustration which do not constitute departures from the spirit and scope of the invention.

While a fast food chain type of character and a super hero have been illustrated, it is obvious that other characters, or recognizable figures, may be utilized in forming the handle 24 or 124. For example, various sports figures for football, baseball, basketball and the like, as well as various super hero-type characters may be employed. Additionally, other caricatures may be utilized whether for clown, animals, etc., depending upon the end results desired.

While the cup holder has been described as being made of plastic, other suitable materials may, of course, be utilized, and those of ordinary skill in the art will at once recognize various changes and modifications to the specifically described embodiment of the invention.

I claim:

1. A plastic cup holder for cooperative association with a handleless cup to provide a graspable handle therefor comprising: an upper, expansible collar portion to receive and retain in releasable fashion a sidewall portion of said cup to be held adjacent said upper expansible collar portion and to substantially encircle said sidewall portion of said cup; a lower, spaced, cooperating support portion, said support portion having an upper surface adapted to releasably receive and engage the bottom of said cup to be held thereon; and an intermediate depending, extending shank portion forming a handle and being connected to and outwardly spaced from said upper collar portion and said lower extending support portion, said collar portion cooperating with said shank portion forming a handle to provide a continuous, closed encircling engagement for said cup.

2. The cup holder in accordance with claim 1 wherein said upper expansible collar portion and said lower extending support portion are of sufficient cooperative extending depth and spacing to form a releasable friction locking engagement with said sidewall portion and said bottom of said cup, respectively, whereby said cup is securely held in releasable fashion.

3. The cup holder in accordance with claim 2 wherein said intermediate depending, extending shank portion is generally arcuate in overall configuration so as to form a hand graspable surface, spaced from the exterior surface of said cup to be held by said cup holder.

4. The cup holder in accordance with claim 3 wherein said upper expansible collar portion and said lower extending support portion are about in parallel, horizontal alignment with respect to said intermediate depending, extending shank portion.

5. The cup holder in accordance with claim 4 wherein said cup has an inwardly directed frusto-conical sidewall and a bottom with a concave portion and said upper surface of said lower extending support portion has a convex portion adapted to frictionally and releasably engage and retain therein said bottom of said cup.

6. The cup holder in accordance with claim 5 wherein the majority of said cup holder is of one-piece, integral construction and is of resilient plastic.

7. The cup holder in accordance with claim 6 wherein said convex portion of said lower extending support portion is recessed into the upper surface of said lower extending support portion so as to receive and retain therein a portion of said sidewall of said cup adjacent said bottom.

8. The cup holder in accordance with claim 7 wherein said intermediate depending, extending shank portion has the shape of a recognizable figure.

9. The cup holder in accordance with claim 8 wherein said upper expansible collar portion is C-shaped.

10. The cup holder in accordance with claim 1 wherein said shank portion is releasably secured to said upper collar portion and to said lower support portion, said releasably secured shank portion including an upper portion and a bottom portion, with said upper shank portion and said upper collar portion including bulbous/receptacle means for releasably engaging said upper shank portion in said upper collar portion; said lower support portion including an extension for supporting said bottom portion of said shank portion; and said lower support portion and said bottom shank portion including bulbous/receptacle means for releasably engaging said bottom shank portion in said extension.

11. A cup holder for cooperative association with a handleless cup to provide a graspable handle therefore comprising: an upper expansible C-shaped collar portion of resilient plastic material having an inwardly canted frusto-conical sidewall, adapted to receive and retain therein, in a releasable friction fit, a portion of the sidewall of said cup adjacent said upper expansible, C-shaped collar portion and to substantially encircle said sidewall portion of said cup; and a spaced, cooperating lower extending support portion having on its upper surface a recessed convex portion with frusto-conical sidewalls adapted to receive and retain therein said bottom and a portion of said sidewall of said cup adjacent said bottom; and an intermediate depending, extending shank portion forming a handle, outwardly spaced from said upper expansible C-shaped collar portion and said lower extending support portion, generally arcuate in overall configuration so as to form a hand graspable surface, spaced from the exterior of said cup, said shank portion adapted to engage the spaced, opposed termini of said C-shaped collar to provide a continuous, closed encircling engagement for said cup.

12. The cup holder in accordance with claim 11 wherein said shank portion is releasably secured to said upper collar portion and to said lower support portion, said releasably secured shank portion including an upper portion and a bottom portion, with said upper shank portion and said upper collar portion including bulbous/receptacle means for releasably engaging said upper shank portion in said upper collar portion; said lower support portion including an extension for supporting said bottom portion of said shank portion; and said lower support portion and said bottom shank portion including bulbous/receptacle means for releasably engaging said bottom shank portion of said shank portion in said extension.

13. A cup holder for cooperative association with a handleless cup to provide a graspable handle therefore comprising: an upper expansible C-shaped collar portion of resilient plastic material having an inwardly canted frusto-conical sidewall, adapted to receive and retain therein, in a releasable friction fit, a portion of the sidewall of said cup adjacent said upper expansible, C-shaped collar portion and to substantially encircle said sidewall portion of said cup; and a spaced, cooperating lower extending support portion having on its upper surface a recessed convex portion with frusto-conical sidewalls adapted to receive and retain therein said bottom and a portion of said sidewall of said cup adjacent said bottom; and an intermediate depending, extending, releasable shank portion forming a handle, outwardly spaced from said upper expansible C-shaped collar portion and said lower extending support portion, generally arcuate in overall configuration so as to form a hand graspable surface, spaced from the exterior of said cup, said shank portion releasably secured to said upper collar portion and said lower support portion, said shank portion adapted to engage the spaced, opposed termini of said C-shaped collar to provide a continuous, closed encircling engagement for said cup.

14. A cup holder for cooperative association with a handleless cup to provide a graspable handle therefore comprising: an upper expansible C-shaped collar portion of resilient plastic material having an inwardly canted frusto-conical sidewall, adapted to receive and retain therein, in a releasable friction fit, a portion of the sidewall of said cup adjacent said upper expansible, C-shaped collar portion and to substantially encircle said sidewall portion of said cup; and a spaced, cooperating lower extending support portion having on its upper surface a recessed convex portion with frusto-conical sidewalls adapted to receive and retain therein said bottom and a portion of said sidewall of said cup adjacent said bottom; and an intermediate depending, extending, releasable shank portion forming a handle, outwardly spaced from said upper expansible C-shaped collar portion and said lower extending support portion, generally arcuate in overall configuration so as to form a hand graspable surface, spaced from the exterior of said cup, said shank portion including an upper portion and a bottom portion, said upper portion of said shank portion including means for releasably engaging in said upper collar portion, said upper collar portion including means for receiving said releasable engaging means, said lower support portion including an extension for supporting said bottom portion of said shank portion, and said lower support portion further including means for releasably engaging in said bottom portion of said shank portion, said bottom portion including corresponding means for receiving said releasable engaging means, said shank portion adapted to engage the spaced, opposed termini of said C-shaped collar to provide a continuous, closed encircling engagement for said cup.

15. The cup holder in accordance with claim 10 wherein said upper shank portion is provided with bulbous engaging means and said upper collar portion is provided with receptacle means for cooperatively engaging said bulbous means and wherein said extension is provided with bulbous engaging means and said bottom shank portion is provided with receptacle means for cooperatively engaging said bulbous means.

16. The cup holder in accordance with claim 12 wherein said upper shank portion is provided with bulbous engaging means and said upper collar portion is provided with receptacle means for cooperatively engaging said bulbous means and wherein said extension is provided with bulbous engaging means and said bottom shank portion is provided with receptacle means for cooperatively engaging said bulbous means.

17. The cup holder in accordance with claim 13 wherein said upper shank portion is provided with bulbous engaging means and said upper collar portion is provided with receptacle means for cooperatively engaging said bulbous means and wherein said extension is provided with bulbous engaging means and said bottom shank portion is provided with receptacle means for cooperatively engaging said bulbous means.

18. The cup holder in accordance with claim 14 wherein said upper shank portion is provided with bulbous engaging means and said upper collar portion is provided with receptacle means for cooperatively engaging said bulbous means and wherein said extension is provided with bulbous engaging means and said bottom shank portion is provided with receptacle means for cooperatively engaging said bulbous means.

* * * * *